United States Patent [19]

Gravelle

[11] Patent Number: 4,867,633

[45] Date of Patent: Sep. 19, 1989

[54] CENTRIFUGAL PUMP WITH HYDRAULIC THRUST BALANCE AND TANDEM AXIAL SEALS

[75] Inventor: Homer E. Gravelle, Arvada, Colo.

[73] Assignee: Sundstrand Corporation, Rockford, Ill.

[21] Appl. No.: 156,759

[22] Filed: Feb. 18, 1988

[51] Int. Cl.[4] ..... F01D 11/00

[52] U.S. Cl. ..... 415/106; 415/113; 415/170.1

[58] Field of Search ..... 415/110, 104, 170 A, 415/131, 132, 106, 113, 173 R

[56] References Cited

U.S. PATENT DOCUMENTS

| | | | |
|---|---|---|---|
| 1,860,817 | 5/1932 | Peterson | 415/104 |
| 4,236,867 | 12/1980 | Morris | 415/110 |
| 4,538,960 | 9/1985 | Iino et al. | 415/104 |

FOREIGN PATENT DOCUMENTS

| | | | |
|---|---|---|---|
| 413135 | 6/1910 | France | 415/106 |

OTHER PUBLICATIONS

Bulletin 1.4 of Sundstrand Fluid Handling Unit of Sundstrand Corporation and which discloses a canned motor pump known more than a year prior to the filing of the subject application.

A sheet showing six Figures with Figures (a) and (b) being taken from a book entitled *Centrifugal and Axial Flow Pumps* of A. J. Stepanoff, published in 1957; Figures (c) and (d) being taken from a book entitled *Pump Handbook,* author I. J. Karassik et al., published 1976 and with supplementing pp. 2–64 through 2–67 also being submitted; and Figure (e) taken from a publication of NASA SP-8109, published 1973, entitled *Liquid Rocket Engine Centrifugal Flow Turbo Pumps;* and Figure (f) is a Figure from a Book entitled *Centrifugal Pumps and Blowers,* author A. H. Church, published 1944.

Pp. 80–82, publication entitled *Power,* vol. 118, No. 6 of Jun. 1974.

*Primary Examiner*—Everett A. Powell, Jr.

*Attorney, Agent, or Firm*—Wood, Dalton, Phillips, Mason & Rowe

[57] ABSTRACT

A centrifugal pump with hydraulic thrust balance and tandem axial seals. The centrifugal pump has an impeller with front and rear axial seals operating in unison to either reduce or increase the size of gaps therebetween. The gaps are of a minimal dimension to minimize leakage. The rear axial seal is located at the tip of the impeller with the front axial seat located either at the impeller eye or radially outwardly thereof. Hydraulic thrust balance is achieved and continuously maintained by axial movement of the impeller shaft and impeller to modulate the gap at the rear axial seal and, thus, control the value of an effective pressure acting on the back side of the impeller whereby an outward thrust force resulting therefrom counterbalances an inward thrust force resulting from pressure acting on the front shroud of the impeller. A clearance at the rear of the impeller communicates with suction pressure through a restricted passage. Impeller hydraulic thrust balance forces usually dwarf other thrust forces which are considered to be external thrusts without significant impact on overall thrust balance. Examples of external thrusts are those that arise from suction pressure acting over the process seal area and from helical gears in integral gear driven systems. A normally preferred thrust balance design is appropriate for the majority of pump applications, but design alternatives are offered for inordinate pump applications which provide maximum capacities to handle either outward or inward external thrust loads.

13 Claims, 4 Drawing Sheets

CENTRIFUGAL PUMP WITH HYDRAULIC THRUST BALANCE AND TANDEM AXIAL SEALS

DESCRIPTION

1. Technical Field

This invention pertains to a centrifugal pump constructed to totally eliminate thrust loads on the rotating assembly of the pump, which normally must be reacted by the impeller shaft bearings. Additionally, the invention pertains to the use of tandem axial seals on the impeller to minimize leakage. A rear axial seal is constructed and located to provide in coaction with other structure the elimination of hydraulic thrust forces on the rotating assembly with minimal leakage from the back side of the impeller and a front axial seal operates in tandem with the rear axial seal to provide a low leakage seal back to suction pressure. Large hydraulic forces act in opposite directions on the front and back shrouds of the impeller to cancel each other and additionally provide capacity to react other thrust forces imposed on the impeller shaft assembly in either direction. Thrust equilibrium is continuously sought, so any change in external thrust forces is immediately compensated and thrust equilibrium is maintained.

2. Background Art without special design features, it is a well known characteristic of centrifugal pumps to produce thrust loads of substantial magnitude which must be reacted by bearings for the impeller shaft. This thrust is caused by exposure of the clearances between the front and rear shrouds of the impeller and the pump case to high pressure generated at the impeller tip. The area of exposure to these high pressures is greater on the back side of the impeller, namely, the rear shroud, than on the front side, namely, the front shroud, with the result that a net out-thrust is produced. This thrust load is magnified in a centrifugal pump designed for high speed because of higher pressure levels at the impeller tip. The hydraulic thrust forces can become very high, forcing the centrifugal pump to be of a heavy duty construction and also requiring the use of expensive, high capacity thrust bearings.

Various design features are known in efforts to reduce, or eliminate, thrust loads. One known design uses equal, or approximately equal, diameter radial clearance wear rings on both the front and rear shrouds of the impeller to reduce hydraulic thrust. However, relatively large radial clearances in the two wear rings result in high leakage losses. These large leakage losses occur because the radial gaps must be relatively large in the initial design for reliability reasons and because the gaps will increase as the result of wear from pump operation.

Another known design utilizes radial ribs on the rear shroud, functioning as pumping elements to alter the back side pressure profile, thus reducing the thrust loads to levels acceptable for the thrust bearings. Frequently, use of such radial ribs is not permitted because axial shift of the impeller shaft alters the effectiveness of this type of structure, with attendant reduction in reliability.

It is also known to design centrifugal pumps with balance drums or balance discs, or a combination of such balance drums and balance discs, to control thrust. A balance drum structure has radial clearances with resulting high leakage loss and embodies fixed geometry so that only approximate thrust balance can be achieved. Balance discs do have variable geometry and can achieve full thrust balance. A balance disc structure has a balance chamber having a fluctuating pressure, with the result that the shaft process seal is exposed to the fluctuating pressure in the balance chamber with substantial detriment to the life of the shaft process seal.

A centrifugal pump having a series-flow balance piston integral with the impeller has been reported. Axial seals at the impeller periphery and near the hub face oppositely and act in cooperation to provide thrust balance. Opposite-facing control gaps require that generous control clearances be built into the assembly for safe operation considering deflections and thermal expansions, with the result that impeller backside leakage tends to be high.

All of the aforesaid known designs use radial wear rings on the front shroud at the impeller eye and, thus, have relatively high leakage rates through the radial wear rings back to suction pressure.

DISCLOSURE OF THE INVENTION

A primary feature of the invention is to provide a centrifugal pump with hydraulic thrust balance and minimal leakage. More particularly, the invention pertains to a centrifugal pump having an impeller with a rear axial seal at the impeller tip to achieve hydraulic thrust balance and with minimal leakage to suction pressure from the rear of the impeller, and a front axial seal which, with the rear axial seal, defines tandem axial seals operating in unison and which also minimizes leakage from the front of the impeller to suction pressure.

In one embodiment of the centrifugal pump, the hydraulic thrust balance with minimal leakage is achieved by having a flange at the periphery of the back shroud which is axially opposed to a flange in the pump case and a front shroud axial face opposed to a housing face usually located at the impeller inlet eye. The axial length between sealing lands on the impeller is made the same within narrow tolerance as the sealing lands in the pump case. The impeller sealing lands face in the same axial direction whereby the pair of axial seals operate in tandem in establishing the size of the axial gaps between the sealing surfaces.

It is characteristic of a centrifugal pump that high pressure at the impeller tip decays to lower pressures at smaller diameters within the impeller-housing clearance space. This pressure decay is along a parabolic profile that can be described nominally by v/2 velocities, with v being impeller shroud velocity. This results from fluid being exposed to the impeller shroud at one surface and to the stationary cavity wall at the other surface of the containment gap or clearance. Consequently, the fluid in the gap rotates at roughly one-half of the impeller peripheral speed depending on the relative roughness of the surfaces. The axial force on a shroud is equal to the pressure at the RMS (root-mean-square) diameter of the exposed shroud times the area of the exposed shroud. Front shroud hydraulic force is nearly independent of the sealing gap widths because the frontside gap is located at the downstream end or exit of the shroud exposure annulus. Thus, large clearance always exists at the impeller frontside periphery and change in the frontside pressure profile due to seal gap modulation is negligible.

Pressure on the backside of the impeller varies as a function of the impeller axial position which establishes the restriction gap at the peripheral seal land. This variable restriction and a second fixed restriction in the backside return-to-suction flow path fix the backside pressure level. Thrust control stems from modulation of the seal land gap at the impeller back shroud periphery. Outward impeller motion closes the seal control gap, lowers backside pressure, so lessens impeller outward force. Opposite impeller motion produces opposite effects.

The control gap equilibrium width varies directly with sizing of the secondary backside flow restriction. Sizing of the secondary flow restriction produces no significant effect on the impeller backside pressure or hydraulic thrust force. Appropriate sizing of the backside restriction is governed only by the considerations that undersizing risks rubbing contact at the control gap while oversizing allows excessive leakage loss and pump efficiency depression. Experience has shown that the return-to-suction restriction can be sized to positively avoid rubbing contact at the control land, yet provide for substantially lower leakage loss than occurs with conventional radial clearance wear rings.

In the normally preferred embodiment of the invention, the front seal gap is located at the impeller eye diameter so the entire frontside shroud area is utilized to produce inward hydraulic thrust force. Backside shroud area extends from the impeller tip to a narrow radial clearance at the impeller hub which serves as the return-to-suction restriction. Generously-sized holes are located at a smaller diameter than the return to suction restriction annulus, so the process seal cavity is communicated with pump suction pressure. This arrangement provides the dual advantage of isolating the process seal from high impeller backside thrust balancing pressure as well as from pressure fluctuations generated by the thrust balancing system action and by those fluctuations normally associated with centrifugal pump action. This isolation enhances the life expectancy of the process seal.

Variations from the preferred embodiment may be desirable to provide designs best suited for out of the ordinary pump application conditions. It is necessary that the backside shroud area be larger than the frontside shroud area to make the balance system functional. Generally, it is desirable to choose a small pitch diameter for the backside secondary restriction, thus providing maximal backside shroud working area for thrust balancing. But the minimum diameter choice may be tempered by considerations such as desire to provide a suction return path through the impeller hub or by judgment on the acceptability of utilizing an externally-piped return. It is not essential that the control seal be located at the impeller periphery, but this choice offers the advantages of maximal back shroud working area and of mechanical strength and simplicity. Locating the seal land inward from the impeller periphery would require piecing the impeller seal structure to make assembly possible.

Frontside design variation involves choice of diameter for the front shroud sealing lands. The choice here is the inverse of that in backside shroud working area sizing in that large seal diameters decrease frontside shroud working area, and so reduce inward hydraulic thrust. A prime need for high capacity to react inward thrust arises in applications with very high pump suction pressures, which act over the process seal area to produce high inward thrust. Caution is necessary in downsizing of the front shroud working area to augment capacity to react inward thrust due to high suction pressure. Thrust equilibrium should be possible either with or without the high suction pressure so that system failure or distress does not occur in the event of loss of, or interruption of, the high suction pressure level.

An object of the invention is to provide a new and improved centrifugal pump having hydraulic thrust balance and tandem axial seals.

Still another object of the invention is to provide a centrifugal pump having tandem axial seals associated with the front and rear shrouds of the impeller of the centrifugal pump and with the rear axial seal providing control for hydraulic thrust balance.

Still another object of the invention is to provide a centrifugal pump having tandem axial seals associated with the front and rear shrouds of the impeller and which operate in unison to control the size of the gap in the seals and with variations in various embodiments of the centrifugal pump providing systems which will achieve total thrust balance despite operating conditions which are variable within predictable allowable limits.

A further object of the invention is to provide a centrifugal pump having improved dynamic thrust balance provided by a double shrouded impeller equipped with tandem axial seal lands acting relative to opposed pump case seal lands. The impeller seal land surfaces on the front and rear shrouds face in the same direction whereby the axial seals move in tandem in either seal closing or opening directions.

A further object of the invention is to provide a thrust balance and seal system for a centrifugal pump having a pump case and an impeller having front and rear shrouds rotatably mounted in said pump case by an impeller shaft, the improvement comprising, a pair of axially-facing seal surfaces on the impeller and oppositely-facing surfaces on the pump case, to define a pair of axial seals, one of said axial seals defining an axial seal for the rear shroud of the impeller and the other axial seal defining an axial seal for the front shroud of the impeller, and said seal surfaces on the impeller facing in the same direction toward the inlet end of the pump whereby the pair of axial seals operate in tandem in gap-opening or closing movement.

In the aforesaid thrust balance and seal system a front shroud axial seal can be radially adjacent the eye of the impeller or, in a different embodiment, can be located between an impeller eye and the tip of the impeller to enable functioning of the centrifugal pump with increased maximum suction pressure.

Further, the aforesaid thrust balance and seal system has a rear axial seal with a seal surface at the tip of the impeller which causes a pressure drop from impeller tip pressure which varies as a function of gap width and so acts to vary backside impeller pressure and hence vary outward thrust force. This forms the basic hydraulic mechanism in which thrust equilibrium is continuously sought. Small shaft axial motion modulates the peripheral seal gap width so that the combination of front shroud force and external thrust forces are identically opposed by backside force.

DESCRIPTION OF THE PREFERRED EMBODIMENT

Figure 1:
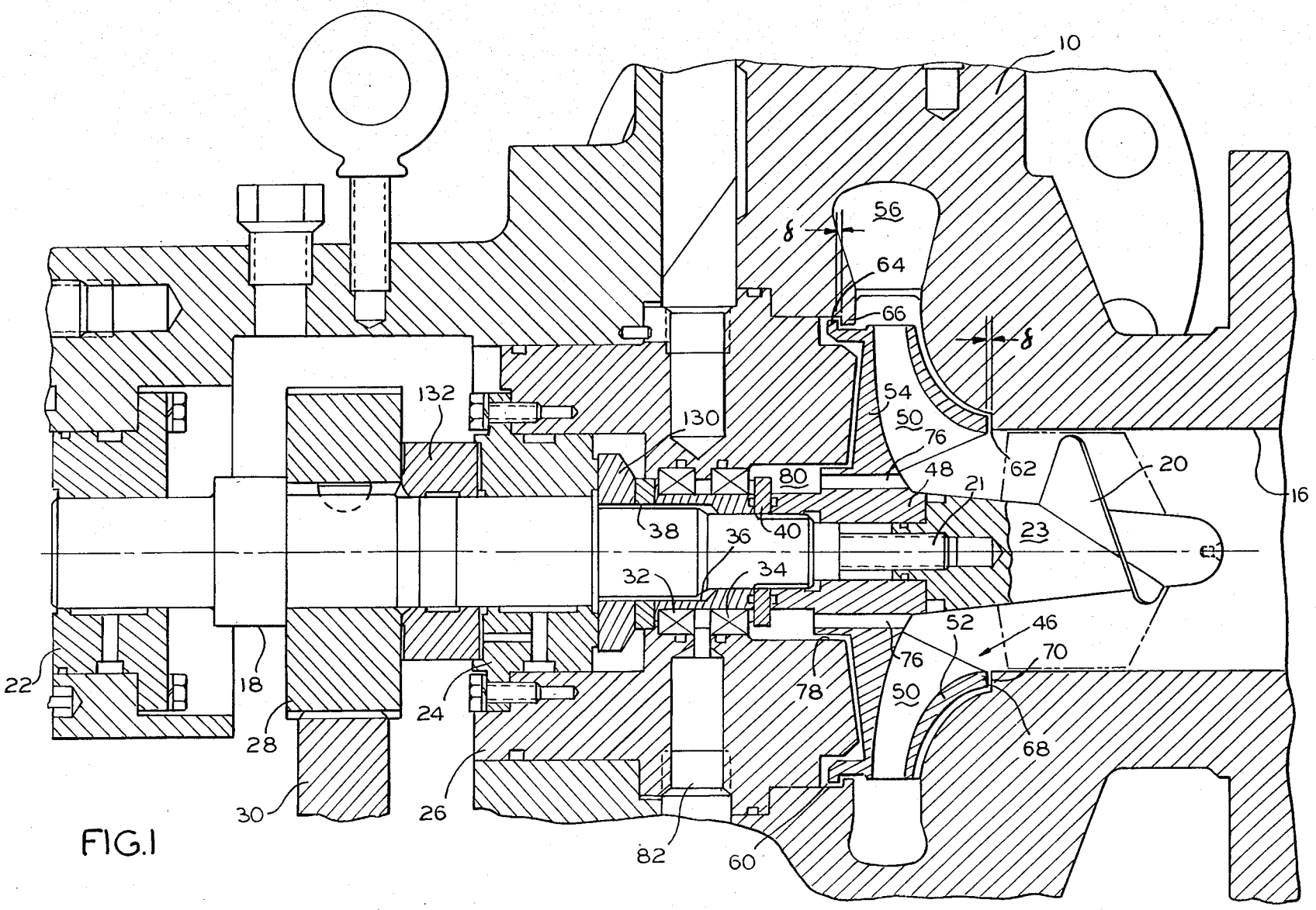
FIG. 1 is a fragmentary, central section of a first and generally preferred embodiment of the centrifugal pump.

A first embodiment of the centrifugal pump is shown in FIG. 1. A pump case 10 has a central bore housing a number of components and a fluid inlet 16.

An impeller shaft 18 is positioned in said bore and threadably mounts a conventional inducer 20 at one end positioned within the fluid inlet, as shown at 21, and is rotatably supported in a rear journal bearing 22 fixed into the pump case 10 and a front journal bearing 24 fixed to a seal housing 26 fitted in a section of the bore in the pump case. Rotation is imparted to the impeller shaft 18 through a gear drive from a power source including a gear 28 on the impeller shaft and a meshing drive gear 30. The seal housing 26 mounts a pair of cartridge seals 32 and 34 of known, commercially-available construction, which coact with a sleeve 36 on the impeller shaft and a pair of annular discs 38 and 40 whereby the cartridge seal 32 forms an oil seal and the cartridge seal 34 forms a process face seal.

An impeller, indicated generally at 46, has a hub 48 mounted on the impeller shaft and held in position against the annular disc 40 by a hub 23 of the inducer and a plurality of vane 50 extend outwardly from an eye of the impeller, with their outer ends being at an impeller tip. These vanes extend between a front shroud 52 and a rear shroud 54 of the impeller. Rotation of the impeller shaft 18 and the impeller 46 results in pumping of fluid received at the inlet 16, with the fluid being directed to a collector, in the form of a volute, surrounding the impeller tip and with the volute communicating with a pump outlet (not shown).

The impeller has tandem axial seals including a rear axial seal, designated generally at 60, and a front axial seal, indicated generally at 62. The rear axial seal 60 is defined by opposed faces of flanges at the impeller periphery or tip including a flange 64 integral with and to the rear of the rear shroud 54 having an operative face facing toward the inlet end of the pump case and which is movable within a recess provided in the pump case relative to a flange 66 provided on the pump case section 10. The front axial seal 62, located at the impeller eye, has opposed axial faces including a face 68 on the front shroud 52 of the impeller and a face 70 on the pump case section 10.

The impeller and adjacent case section 10 as well as the seal housing 26 are dimensioned and constructed to provide a maximum seal axial gap on the order of 0.030". However, in the equilibrium condition to be described, the pump typically operates with a seal gap on the order of 0.003" between the axial seal components with resulting minimal leakage. The control gap operational width is proportional to the backside secondary flow restriction area which can be varied as desired by the designer, so the control gap width is a parameter that may be varied at the discretion of the designer. Extremely narrow gaps risk seal land rubbing contact, while overly wide gaps allow excessive leakage loss. Gap variations within normal ranges do not cause any appreciable change in the thrust balance pressure profiles. The rear axial seal 60 and front axial seal 62 define tandem axial seals in that the seals act in unison in moving in either gap opening or closing directions.

A clearance exists between the outer face of the front shroud 52 and an adjacent wall of the pump case 10 whereby a pressure, to be described, which is at some pressure below that of fluid pressure at the impeller tip may act to exert an inward thrust on the impeller. There is some leakage from said clearance to suction pressure intermediate the inducer 20 and the entry end of the vanes but the leakage is minimal because of the front axial seal 62.

A clearance exists behind the rear shroud 54 provided by a space between the rear face of the rear shroud and an adjacent surface of the seal housing 26. A pressure existing in this clearance acts on the rear face of the rear shroud to exert an outward thrust force in opposition to the inward thrust force. Fluid in the rear clearance may reach suction pressure at the impeller eye by means of a restricted passage including a plurality of through passages 76 in the impeller hub 48. A flow restricting clearance existing at 78 between the outer periphery of the impeller hub and an adjacent surface of the seal housing 26 provides the restriction in the return path to suction pressure and minimizes leakage.

A process seal cavity 80 to the rear of the impeller hub 48 is maintained at suction pressure due to generously-sized passages 76 through the impeller hub. In inducer-equipped pumps, as is shown in FIG. 1, the seal cavity pressure is at a pressure a small amount higher than suction pressure due to the pressure rise produced by the inducer. A drain and vent port 82 references the cavity between process seal 34 and lube oil seal 32 to atmospheric pressure. Thus, process seal 34 is always limited to a pressure differential equal nominally to the pump suction gage pressure. Further, the process seal is isolated from pressure fluctuations due to actions of the thrust balance system as well as from such pressure disturbances as those produced by impeller blade pass and discharge control valve modulation. Low and steady pressure differentials across the process seal 34 enhance its life expectancy.

The centrifugal pump shown in FIG. 1 totally eliminates impeller hydraulic thrust and minimizes leakage losses. Because of the strong thrust balance forces, the impeller consistently maintains small seal gaps between the components of the front and rear axial seals under changing pump operating conditions. The seal gaps are free to change in unison because the shaft bearings and seals permit this nominal axial freedom.

Hydraulic thrust balance is achieved by the rear axial seal 60 and associated structure and may be described in connection with the graph of FIG. 2, which is a pressure profile diagram showing pressures above suction pressure on the horizontal axis and diameters of the shrouds subject to such pressures on the vertical axis. Worded otherwise, only pressures produced by impeller action are indicated in the pressure profile diagram, so only the hydraulic thrust forces generated by the impeller are considered. Inward thrust on the rotating assembly exists due to suction pressure acting over the process seal area, but this force and any other thrust forces imposed on the impeller are considered to be external forces which the thrust balance system must react. Examples of other external thrust forces include such things as thrust reaction due to turning of the pumped fluid from the axial to the radial direction within the impeller, use of helical drive gears, and shaft dead weight in vertically-oriented pumps. Usually external thrust loads are small in comparison to the hydraulic thrust balancing capacity, so these external thrusts can normally be neglected without significant impact on assessments of thrust handling capacity.

Figure 2:
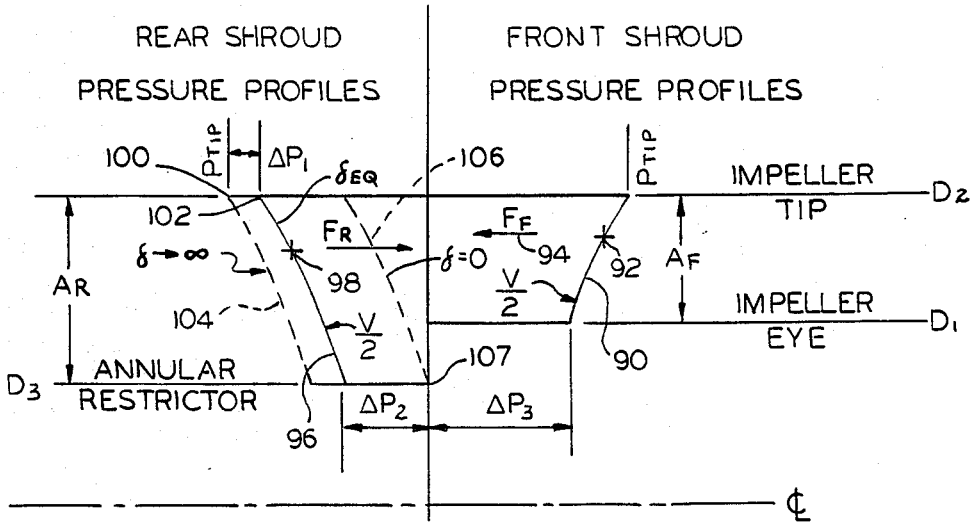
FIG. 2 is a graph showing a pressure profile diagram for the centrifugal pump shown in FIG. 1.

For clarity, the graph of FIG. 2 has the shroud diameters to the same scale as the centrifugal pump of FIG. 1. High pressure at the impeller tip decays to a lower pressure within the front and rear clearances associated with the front and rear shrouds due to fluid being exposed to impeller shroud velocity, v, at the impeller shroud interface and to the stationary cavity wall at the other interface. Consequently, the fluid in the clearance rotates at roughly one-half of the impeller surface speed, depending upon the relative roughness of these surfaces. The impeller tip pressure decays along a parabolic profile described by v/2 nominal velocities. The parabolic profile for the pressure acting on the front shroud 52 to exert an inward thrust is indicated by a line 90. The highest pressure is at the impeller tip which is at diameter $D_2$ and the lowest pressure is at the impeller eye, which is diameter $D_1$, with the diameter $D_1$ being the mean diameter defined by the front axial seal face 62. Thus, the pressure within the front clearance acts on an area between diameters $D_2$ and $D_1$, shown as area $A_F$. The effective frontside pressure is described by the v/2 profile, indicated as line 90. It can be shown mathematically that the force produced by this pressure profile is equal to the pressure at the RMS diameter times the area of pressure exposure, as established by diameters $D_2$ and $D_1$. The cross indicated as 92 in FIG. 2 indicates the RMS point along the v/2 pressure profile. It may also be shown mathematically that the pressure at the RMS diameter is equal to the mean of the pressures at $D_2$ and $D_1$. Front shroud hydraulic force is inward, as indicated by $F_F$ and the arrow at 94. The front shroud pressure at $D_1$ indicates the pressure differential across the front shroud seal land, indicated as $\Delta P_3$ on FIG. 2.

The backside or rear equilibrium pressure profile acting on rear shroud 54 is indicated by the line 96, which also carries the label $\delta_{EQ}$ indicating an equilibrium control land gap width corresponding to the equilibrium pressure profile. Negligible external thrust forces are assumed, so the backside RMS equilibrium pressure is equal to $F_F$ divided by the backside area of pressure exposure $A_R$, with backside RMS diameter and area being defined by diameters $D_2$ and $D_3$. Extending the backside equilibrium pressure profile to 102 at diameter $D_2$ establishes the equilibrium control land seal pressure differential $\Delta P_1$, and extending this profile to diameter $D_3$ establishes the pressure differential $\Delta P_2$ across the annular restrictor 78 at the impeller hub.

Pressure profile 104 shows the condition existent when the impeller is displaced inward as much as possible and the control gap width is at maximum. Pressure drop across the control lands is negligibly low so the backside pressure is at maximum, producing the maximum available thrust force to move the impeller outward. The notation $\delta \rightarrow \infty$ on pressure profile 104 reads "delta (gap) approaches infinity" or, more simply, that the control gap is wide open. Maximum outward impeller thrust urging the impeller toward equilibrium in this mode (closing the gap) is equal to the product of the pressure difference to equilibrium times the backside shroud area, $\Delta P_1 \times A_R$.

Conversely, pressure profile 106 shows the condition existent when the impeller is displaced outward as far as possible, limited by the circumstance of zero control gap width. Pressure profile 106 emanates from point 107 indicative of zero pressure differential across the annular restrictor, which is in agreement with the condition of zero backside flow forced by zero control seal gap width. Zero gap width is an unacceptable condition since this would entail rubbing contact at the seal lands and system damage, but this condition remains as one extreme of the theoretical operating limits. The label $\delta=0$ on pressure profile 106 indicates the zero gap condition, completing the identification of the backside pressure profiles. Maximum inward impeller thrust urging the impeller toward equilibrium in this mode (opening the gap) is equal to the product of the pressure difference to equilibrium times the backside shroud area, $\Delta P_2 \times A_R$.

Figure 3:
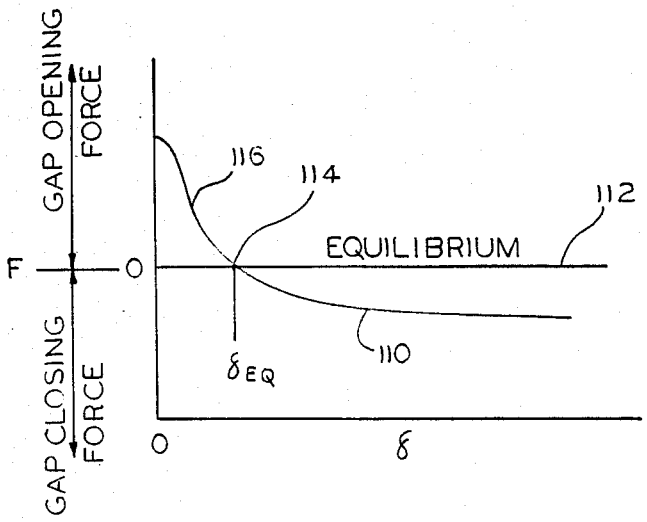
FIG. 3 is a graph illustrating force available for thrust balance related to the size of the gap in the rear axial seal.

Restoration force availability to urge the impeller toward equilibrium from either direction is shown in FIG. 3 by the curved line which intersects the horizontal reference line 112 at the equilibrium gap indicated as 114. The part 110 of the equilibrium curve shows net closing forces F for control gaps larger than the equilibrium gap. The part 116 of the equilibrium curve shows net opening forces F for control gaps smaller than the equilibrium gap. Note that a favorable design bias exists in that the maximum force availability to prevent zero control gap operation is substantially larger than the force availability for closing the seal control gap, thus providing large capacity to prevent seal land rubbing contact. This situation is also reflected in FIG. 2 which shows greater area between the zero gap curve 106 and equilibrium curve 96 than between the full open gap curve 104 and equilibrium curve 96. Force availabilities are proportional to these areas.

Equilibrium control is provided almost totally by the control gap at the rear axial seal and the gap at the front axial seal 62 follows in tandem with the gap of the rear axial seal to provide a low leakage seal with nearly negligible influence on thrust control. The axial gaps may be much smaller without risk of failure than are allowable with prior art radial gaps as provided by wear rings and the axial gaps can reduce leakage on the order of 80–90% below leakage associated with radial gaps having typically specified clearances.

It is essential to the function of the thrust balancing system that fluid at the rear of the impeller be returned to suction pressure either by way of a restriction through the impeller shroud or a return path extending around the impeller. The control gap width varies in direct relationship to the return restriction, so total backside return blockage would mean zero return flow, but also would mean zero control land gap and rubbing contact leading to pump destruction. Conversely, an oversized return restriction would allow excessive leakage loss and depressed pump efficiency. In general, the return restriction should be sized for minimal return flow, but a flow adequate to prevent sealing land contact under all pumping conditions.

In FIG. 1, the clearance 78 provides the annular restrictor to minimize leakage to suction pressure. As previously stated, the cavity 80 communicates with suction pressure whereby the pressure differential across the process face seal 34 is minimal and the seal is isolated from impeller blade pass pressure fluctuations as well as pressure fluctuations in the thrust balancing pressure acting at the backside of the impeller.

Figure 4:
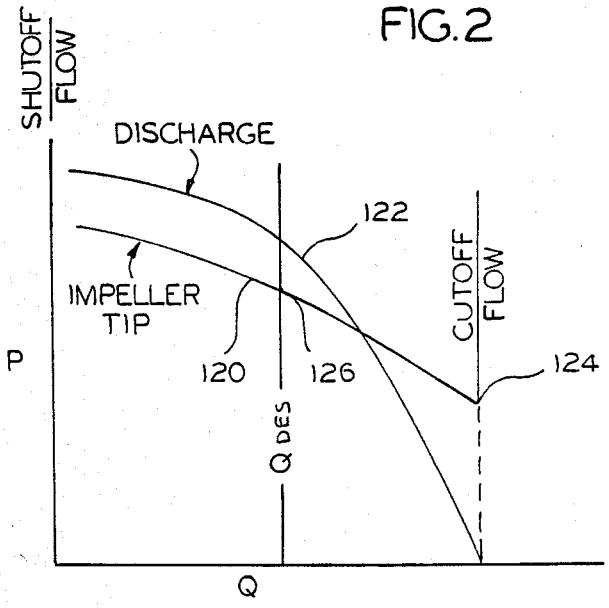
FIG. 4 is a graph comparing typical pump discharge pressure and impeller tip pressure through the full pump flow range.

Discussion of the thrust balance system thus far has assumed pump operation at the design head and flow conditions, but pumps frequently are operated at off-design conditions and adequacy of thrust balancing is required under all operating conditions. Typical pressure and flow trends for full emission centrifugal pumps are shown in FIG. 4. Discharge pressure is shown as curve 122, and impeller tip pressure is shown as curve 120. Impeller tip pressure provides the driving potential for hydraulic thrust balance and the magnitude of the thrust forces are in direct relationship to the impeller tip pressure. Thus, it is seen that available thrust forces increase as flow is reduced below design flow, but decrease as flow is increased above design flow.

If all system resistance is removed from a centrifugal pump discharge, flow will be at the maximum but discharge head will have diminished to zero. This operating condition is referred to as cutoff flow. Although pump operation at cutoff provides no useful purpose and is normally avoided, thrust balance system viability under this abnormal operating condition is necessary to make the thrust balancing concept completely acceptable. Referring again to FIG. 4, it is seen that impeller tip pressure at cutoff, 124, is on the order of half of the design flow tip pressure, 126, and although thrust capacity has diminished, the pressure level remains fully adequate to provide the thrust balance function.

The thrust balance capability of the thrust balance system is dynamic in nature and the system continuously seeks equilibrium and continuously responds to any change in conditions which affect axial thrust on the pump rotating assembly. Test experience has shown that in a pump which operated with a nominal control land gap of about 0.003", the change in the operating gap was only about 0.001" in traversing the full pump flow range.

The thrust balance system eliminates need for a thrust bearing to react outward thrust forces and no such thrust bearing is shown in FIG. 1. At pump start-up, suction pressure acts over the area of the process shaft seal 34 to produce an inward thrust force. Since the balance system is dynamic in nature, it cannot influence the position of the impeller shaft without shaft rotation and the attendant pressure rise through the impeller. The inward force existing at start-up is reacted by thrust bearing features included in journal bearing cartridge 24 acting in opposition to thrust runner 130. During start-up acceleration, the balance system becomes active, axially shifting the impeller shaft 18 to the equilibrium position. At this time, the thrust bearing 130 is no longer functional.

There is an abnormal, but possible, condition wherein the pump could run dry and rubbing of the seal surfaces of the front and rear axial seals could occur causing damage to the pump. This would occur if the pump should be started with an empty inlet line or a closed inlet valve. In order to prevent this occurrence, a small, inward bias force to keep the axial seals open is provided by means of a hydrostatic bearing provided by coaction between the journal bearing 24 and a bearing member 132 which abuts against the gear 28 fixed to the impeller shaft 18. The bearing is operated by lubrication oil from a speed-increasing gearbox drive and dimensioning is such that no metallic contact ever occurs in the hydrostatic bearing. The inward thrust bias produced by the hydrostatic bearing is negligible compared to the hydraulic thrust balance forces, so the bearing introduces insignificant effect on the thrust balance system. Other means of providing a small control gap opening bias force, such as a spring-loaded thrust bearing, could alternatively be used.

The thrust balance system provides for ease of assembly and field maintenance, since no delicate measurements or adjustment features are required to build a unit. In manufacture, the axial dimensions between the sealing lands of the impeller and the lands of the pump case are simply made identical, neglecting small manufacturing tolerance allowances.

Solely for explanatory purposes and without intent to limit the scope of the invention disclosed herein, numeric values can be applied to the pressure profile diagram described in FIG. 2 respecting the centrifugal pump disclosed in FIG. 1. Assuming a pump rotating at 10,500 rpm and pumping water with a resulting impeller tip pressure of 400 psi, the pressure in the clearance at the front shroud of the impeller would decay to approximately 358 psi at the RMS diameter of 4.91", based upon diameter $D_1$ being 3.5" and diameter $D_2$ being 6", and equates to a backside shroud area of 18.65 square inches. The resulting frontside force $F_F$ is then 6677 pounds with a frontside seal land differential pressure $\Delta P_3$ of 316 psi. Suction pressure, at 50 psi, for example, may be disregarded, since this pressure operating over a process seal area of 2 square inches produces an inward thrust force of 100 pounds, which, if added to the hydraulic thrust $F_F$ would increase inward thrust by only about 1.5%.

Backside shroud area extends from an outer diameter $D_2$ of 6" to an inner diameter $D_3$ of 2.3" which equates to 24.12 square inches of shroud exposure and an RMS diameter of 4.54". Frontside force divided by backside area yields the RMS equilibrium backside pressure of 277 psi, and extensions of the equilibrium profile yield values of 69 psi for the pressure differential across the control lands, $\Delta P_1$, and a pressure differential of 223 psi, $\Delta P_2$, across the return annulus restriction. These pressure differentials operating over the backside exposure area provide up to 1664 pounds net closing force availability for gaps larger than equilibrium and up to 5379 pounds opening force availability for gaps smaller than equilibrium.

The numeric example cited above is presented here for the reasons of illustrating the magnitude of thrust balancing hydraulic forces, to clearly show the force availability to prevent control land rubbing contact, and finally to reinforce the claim that thrust balance adequacy exists at the cutoff flow condition. Noteworthy is the favorable bias in equilibrium restoration forces where the force available to prevent control land contact is more than triple the force available to simply close the control gap toward equilibrium.

Pressure developed by a centrifugal pump varies with the square of its rotating speed and directly with the specific gravity of the pumped fluid; accordingly thrust balancing force availability can vary greatly, even with a given pump size. For instance, if the pump in the above example were used at a rotating speed of 3550 rpm, pressure available for thrust balancing is only 11% of that available at the higher speed, so restoration force availability would be reduced by nearly an order of magnitude. Adequate thrust balance capacity usually is available even in low pressure rise pumps, but more strict attention to the thrust forces external to the impeller hydraulic thrust forces is warranted to assure design viability.

DESCRIPTION OF ADDITIONAL EMBODIMENTS

Figure 5:
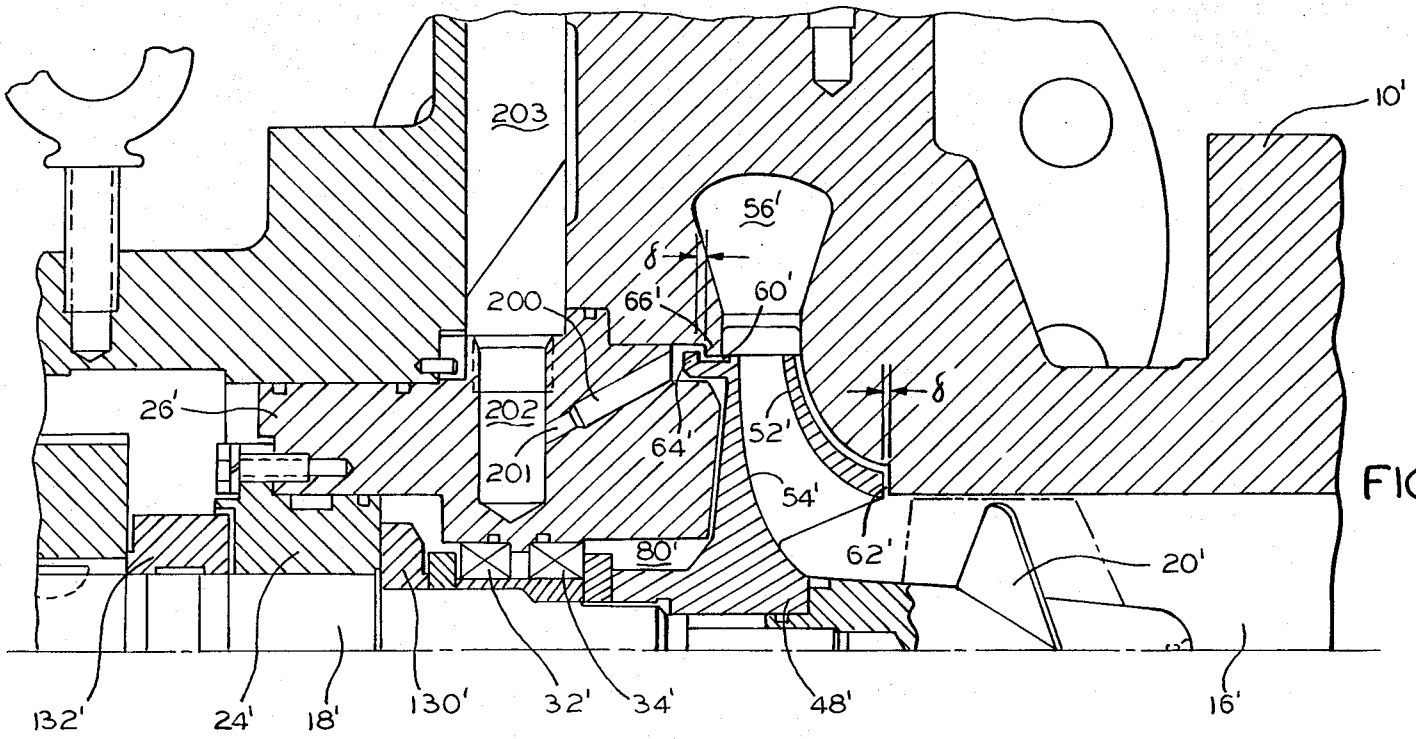
FIG. 5 is a fragmentary, partial central section view of a second embodiment of the centrifugal pump.

A second embodiment of the invention is shown in FIG. 5, with the structure the same as that shown in the embodiment of FIG. 1 and with duplicate reference numerals being affixed with a prime. The performance characteristics of the design depicted in FIG. 5 will be compared here with that of the design depicted in FIG. 1 with the aid of the pressure profile diagram for the former shown as FIG. 6.

Figure 6:
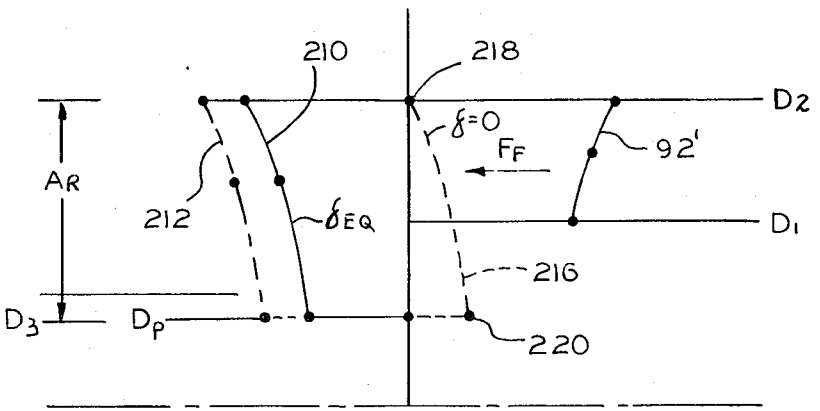
FIG. 6 is a graph of the pressure profile diagram for the second embodiment of the centrifugal pump.

A first difference in FIG. 5 is that the impeller backside pressure area extends down to the process seal diameter, indicated as $D_p$ in FIG. 6, as opposed to $D_3$ which is the annular restriction diameter transferred to FIG. 6 from FIG. 2. In brief, the design in FIG. 5 has more impeller backside working area for thrust balancing than does the design of FIG. 1.

A second difference in FIG. 5 is that the return to suction restriction port is located at the impeller periphery wherein return fluid flows through passage 200 to orifice restriction 201, and then is routed through port 202 and external piping through case clearance 203 back to the pump inlet 16'.

Elucidation on the pressure profile diagram FIG. 6 is in order here in order to reveal the source of maximal outward thrust capacity. The vertical line in FIG. 6 denotes the separation of frontside impeller pressure profiles on one side and of backside pressure profiles on the opposite side. But, pressure profile 216 pertains to the impeller backside and encroaches into the frontside portion of the composite profile diagram. Pressure profile 216 emanates at point 218 where the impeller tip pressure is referenced to suction pressure and decreases according to v/2 velocities terminating to a minimum at point 220. Diagrammed backside pressures which encroach on the frontside portion of the diagram may be thought of as "negative pressures" which contribute to backside force in the same manner as positive pressures acting on the backside. Of course, "negative pressure" is not a physical possibility and this terminology is to be construed to indicate pressures below suction pressure, to which the entire pressure profile diagram is referenced. Validity of "negative pressure" profiles requires that absolute pressure levels at least equal the vapor pressure of the process fluid so that flashing does not occur.

The asset of the design of FIG. 5 is that maximum capacity exists to react outward acting external thrusts on the rotating assembly. This asset is clearly illustrated by comparing the area bounded by profiles 96, 106, and $A_R$ on FIG. 2 with the area bounded by 210, 216 and $A_R$ on FIG. 6. These areas are indicative of force availability to handle outward external thrusts or to prevent rubbing contact at the control lands, and is maximal for the configuration of FIG. 5. Resorting again to the numerical example cited in connection with FIG. 1 where 5379 pounds capacity to react outward thrust was estimated; similar outward thrust capacity estimates for FIG. 5 indicate this capacity at 8,190 pounds.

Disadvantage in the FIG. 5 design exists in that isolation of the process seal from elevated and fluctuating pressure, as in FIG. 1, has been sacrificed. The design presented in FIG. 5 remains as a completely viable option, however, and could be advantageous, for example, in applications where low operating speed provides only modest pressure for the thrust balancing function, yet substantial external outward thrust must be coped with.

Although not shown, it is within the scope of the invention to relocate the return to suction passage 200 from a location adjacent to the impeller tip to a location communicating with cavity 80' at diameter $D_3$. This design results in a pressure profile diagram wherein profile 216 in FIG. 6 is supplanted by a profile indicated as line 106 in FIG. 2. This profile would then extend inward from diameter $D_3$ to $D_p$ so that only a minor "negative pressure" profile appendage would exist. Such design might be opted for in applications where little margin exists from flashing of the pumped fluid.

Described thus far are the extremes of locating the return-to-suction restriction, but it is to be understood that intermediate locations between these extremes may be desirable in some applications and such design variations are embraced in this invention disclosure.

Figure 7:
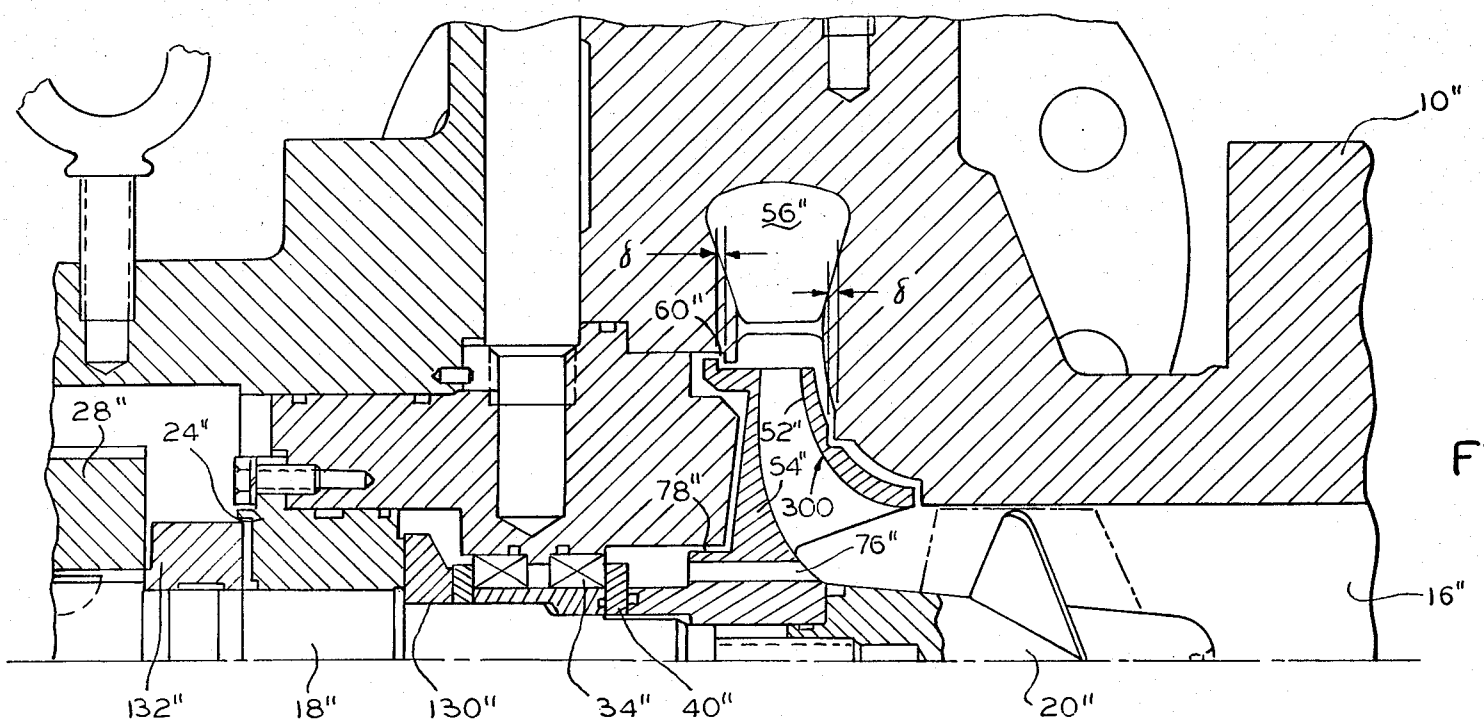
FIG. 7 is a fragmentary, partial central section of a third embodiment of the centrifugal pump.

A third embodiment of the invention is shown in FIG. 7 and structure the same as that shown in the embodiment of FIG. 1 has been given the same reference numeral with a double prime affixed thereto.

The only variation in the embodiment of FIG. 7 from that shown in FIG. 1 is in the radial location of the front axial seal, identified at 300. The front axial seal 300 is intermediate the impeller eye and the impeller tip which, in referring to the graph of FIG. 8, separates the forward face of the front shroud 52'' into two different areas subject to differing pressure profiles.

Figure 8:
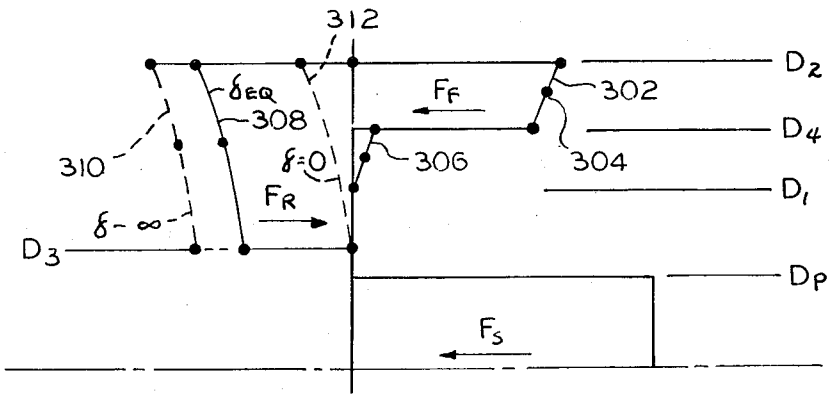
FIG. 8 is a pressure profile diagram for the third embodiment of centrifugal pump.

The front axial seal 300 is located at a diameter $D_4$ and, thus, the previously described pressure profile acting on the front shroud to provide inward thrust force exists along a pressure profile line 302 acting over an area bounded by diameters $D_2$ and $D_4$ which defines a force over that area. A small additional front shroud force exists due to a v/2 pressure profile acting over the area bounded by diameters $D_4$ and $D_1$. The net front shroud force $F_F$ in FIG. 8 is greatly reduced compared to the front shroud force $F_F$ of FIG. 2 where the entire front shroud is exposed to the discharge pressure profile.

The virtue of this design is that reduction of the front shroud hydraulic force increases capacity to handle external inward forces on the rotating assembly with any given backside design. A common, and often significant, external inward thrust force results when high suction pressure acts over the process seal area. External hydraulic force due to suction pressure has been omitted thus far in pressure profile diagrams because this force was assumed to be negligible; but this pressure profile is included in FIG. 8 shown as a high pressure acting out to the process seal diameter $D_p$ and producing inward force $F_S$.

The frontside seal land could be placed at the extremes of the inlet eye or at the impeller tip, or at any intermediate diameter. Increasingly large seal land diameters result in ever lower front shroud force and, thus, ever higher pump suction pressure allowables. Reliability considerations demand, however, that the frontside seal land never be placed at extremely large diameter in order to provide the absolute maximum suction pressure capacity, because such design would entail risk of serious pump failure in the event of loss of or interruption of the high suction pressure level. The backside pressure profile 312 persists even when the control land gap has been reduced to zero, so negligible total frontside counterforce would create the operational condition of extreme rubbing contact in the seal lands and ultimate total failure. Design viability of large frontside sealing land diameters should be verified by calculations assuming the design objective suction pressure as one extreme and zero suction pressure as the other extreme. Prudence would dictate that a comfort margin exist under the zero suction pressure condition, that is to say that equilibrium should not be pushed too close to the 312 profile in FIG. 8 which corresponds to zero control land gap.

I claim:

1. A centrifugal pump having an inlet and improved dynamic thrust balancing of an impeller having front and rear shrouds and provided by a pair of axial seals for the impeller relative to the pump case and wherein said axial seals are associated with the front and rear shrouds of the impeller, the front axial seal being defined by a pair of opposed axial seal surfaces with one seal surface on the pump case and the other seal surface on the front shroud, the rear axial seal being defined by a pair of opposed axial seal surfaces with one seal surface being on the pump case and the other seal surface on the rear shroud at the outer periphery thereof, said seal surfaces on the front and rear shrouds facing in the same direction whereby said axial seal surfaces move in tandem in either seal closing or opening directions, the pump impeller being mounted in said pump case to provide front and rear clearances between the pump case and the front and rear shrouds respectively, the rear shroud having an area exposed to fluid pressure in the rear clearance which is greater than the area of the front shroud exposed to the fluid pressure in the front clearance, and the seal surfaces on the front and rear shrouds facing in a direction opposite to the direction of fluid flow in said pump inlet whereby fluid pressure in the rear clearance controls the gap between the seal surfaces of the front and rear axial seals and an increase in said fluid pressure acts to urge said seal surfaces in a direction to reduce said gaps.

2. A centrifugal pump as defined in claim 1 wherein the axial seal associated with the front shroud is at the inner periphery thereof.

3. A centrifugal pump as defined in claim 1 wherein the axial seal associated with the front shroud is intermediate between the inner and outer peripheries thereof.

4. A thrust balance and seal system for a centrifugal pump having a pump case and an impeller having front and rear shrouds rotatably mounted in said pump case by an impeller shaft, the improvement comprising, a pair of axial facing surfaces on the impeller and which coact with adjacent axial facing surfaces on the pump case to define a pair of axial seals, one of said axial seals defining an axial seal for the rear shroud of the impeller and the other axial seal defining an axial seal for the front shroud of the impeller, said rear shroud axial seal being located at the tip of the impeller to define the outer peripheral dimension of a clearance between the rear shroud and the pump case, said seal surfaces on the impeller face in the same direction whereby the pair of axial seals operate in tandem in opening or closing movement and a restricted passage connecting said clearance with pump suction.

5. A thrust balance and seal system as defined in claim 4 wherein said front shroud axial seal is radially adjacent to the eye of the impeller.

6. A thrust balance and seal system as defined in claim 4 wherein said front shroud axial seal is located at an intermediate diameter between the impeller eye and the impeller tip.

7. A thrust balance and seal system as defined in claim 4 wherein said impeller has a hub and said restricted passage includes a clearance between a portion of said impeller hub and said pump case and a plurality of openings through the impeller hub.

8. A thrust balance and seal system as defined in claim 4 wherein said restricted passage has an inlet radially adjacent said rear shroud axial seal.

9. A centrifugal pump with tandem axial seals for achieving thrust balance on an impeller and minimal leakage comprising, a pump case having an inlet, an impeller shaft rotatably mounted in the pump case, an impeller having a. hub mounted on said impeller shaft and having front and rear shrouds each spaced by front and rear clearances, respectively, from the pump case, a pair of axial seals for the impeller including a rear axial seal having opposed axial annular flanges on the pump case and the rear shroud at the outer periphery of the rear shroud and a front axial seal having opposed axial annular faces on the pump case and on the front shroud of the impeller, the rear shroud having an area greater than the front shroud whereby hydraulic forces exert an outward thrust on the impeller and the hydraulic force on the rear shroud is varied by modulation of the gap between the axial annular flanges of the rear axial seal, said flanges on the front and rear shrouds both facing toward the inlet end of the pump so that said front and rear axial seals act in tandem, and means defining a flow path connecting the rear clearance radially inward of said rear axial seal with pump suction and a flow restriction in said flow path.

10. A centrifugal pump as defined in claim 9 wherein the flow restriction in said means defining a flow path comprises an annular clearance between the impeller hub and the pump case.

11. A centrifugal pump as defined in claim 9 wherein said front axial seal is at the eye of the impeller.

12. A centrifugal pump as defined in claim 9 wherein said front axial seal is intermediate between the eye and the tip of the impeller.

13. A centrifugal pump as defined in claim 9 wherein said flow path has an inlet opening to said rear clearance radially adjacent the rear axial seal.

* * * * *